United States Patent [19]

Petrov et al.

[11] 4,196,059

[45] Apr. 1, 1980

[54] METHOD FOR ELECTROLYSIS OF NON-FERROUS METAL

[75] Inventors: Dimiter A. Petrov, Zlatitza; Ivan P. Shentov, Pirdop; Vladimir V. Genevski, Sofia, all of Bulgaria

[73] Assignee: Medodobiven Kombinat "G. Damyanov", Pirdop, Bulgaria

[21] Appl. No.: 620,113

[22] Filed: Oct. 6, 1975

[30] Foreign Application Priority Data

Oct. 4, 1974 [BG] Bulgaria ..... 27850

[51] Int. Cl.[2] ..... C25C 1/00; C25C 1/12; C25C 7/00; C25C 21/10

[52] U.S. Cl. ..... 204/28; 204/108; 204/261; 204/263

[58] Field of Search ..... 204/261, 273, 28, 207, 204/209, 211, 295, 263, 108

[56] References Cited

U.S. PATENT DOCUMENTS

| | | | |
|---|---|---|---|
| 1,065,090 | 6/1913 | Werth | 204/206 |
| 1,483,722 | 2/1924 | Eustis | 204/263 |
| 1,509,101 | 9/1924 | Dana | 204/28 |
| 1,768,358 | 6/1930 | Harrison | 204/206 |
| 2,061,554 | 11/1936 | Billiter | 204/209 |
| 2,702,260 | 2/1955 | Massa | 204/273 |
| 2,762,763 | 9/1956 | Kenmore et al. | 204/206 |
| 3,506,546 | 4/1970 | Semienko et al. | 204/273 |
| 3,796,646 | 3/1974 | Zambon | 204/273 |
| 3,926,767 | 12/1975 | Bredlinger et al. | 204/28 |

OTHER PUBLICATIONS

Principles of Electroplating & Electroforming by Blum et al, 3rd ed., 1949, pp. 67–68.

Modern Electroplating by F. A. Lowenheim, 2nd ed., 1963, p. 19.

*Primary Examiner*—R. L. Andrews

[57] ABSTRACT

A technique and arrangement for the continuous electrolytic refining or electric extraction from solution of copper or other non-ferrous metal is described. An elongated electrolysis chamber is divided into a pair of separated compartments by means of a membrane which is permeable to the electrolyte used in the process but impermeable to solid, sludge-like impurities generated at the anode of the installation during electrolysis. The anode is fixedly supported in a receptacle disposed in one of the compartments, while the cathode, which preferably is in the form of an elongated continuous rod of circular cross-section, is supported for continuous longitudinal movement through the other compartment. The interface between the moving cathode and the adjacent electrolyte in the associated compartment is preferably agitated in order to increase the speed of transfer of the metallic ions and associated surface-active substances in the electrolyte to the cathode surface.

5 Claims, 10 Drawing Figures

METHOD FOR ELECTROLYSIS OF NON-FERROUS METAL

BACKGROUND OF THE INVENTION

The invention relates to methods and apparatus for the electrolysis of non-ferrous metal, particularly copper.

In existing techniques of electrolysis, at least one anode structure and at least one cathode structure are fixedly supported in an electrolysis tank and are conductively connected by means of an electrolyte, which typically contains ions of the non-ferrous metal involved in the electrolysis, together with a surface-active agent which aids in the crystallization of the metal on the cathode during the process. When such technique is employed for the refinement of the metal (illustratively copper), the metal to be refined is cast or pressed in solid form as the anode, such anode being ideally completely consumed during the electrolysis process. By contrast, when the process is employed for the electrolytic extraction of copper from solution, the anode is formed from a material which is non-reactive to the process, e.g., lead.

In such known processes, there is a practical upper limit to the speed at which the copper ions and the associated surface-active ingredient in the electrolyte is transferred to the surface of the fixed cathode. The layer of electrolyte adjacent such cathode surface has a diffusion-type transfer characteristic, which may be increased somewhat by circulating the electrolyte in the tank. Unfortunately, the process of the electrolysis leads to the generation of solid-sludge-like impurities at the anode, and such sludge is easily dislodged by the moving electrolyte and transferred to the cathode, thereby contaminating the cathode surface and impairing the quality of the resulting electrolytic layer formed thereon. This represents a basic limitation on the process rate attainable with known installations.

Additionally, such known installations require frequent servicing and maintenance, since the fixed cathodes and anodes must be physically removed from the solution, and the anodic sludge and other impurities generated by the process must be manually removed from the bottom of the electrolytic tank from time to time. Such operations are manual in nature, and because of the harmful vapors from the electrolyte and the like, is dangerous to the servicing personnel. When electrolytic refinement of copper is involved, the time and expense of such maintenance is increased because the anode segments to be refined are in practice not completely dissolved, so that the residual segments must be dismounted and replaced.

Also, in known electrolysis installations used for copper extraction, the quality of the copper collected at the cathode is further impaired by the presence of occluded gases therein, typically oxygen which is generated at the anode during such process. Such oxygen migrates freely through the electrolyte from anode to cathode in the common tank, and cannot otherwise be practically utilized or collected because of its contamination with hydrogen and other gases emitted from the cathode during the extraction process.

Another disadvantage of the known electrolysis technique is that the copper, contaminated by sludge and/or occluded gases as noted above, cannot be directly employed in copper rods, bars, and the like, but must be subsequently subjected to further melting and thereafter to casting or other forming processes to produce ultimate products of the desired purity.

Because of the limitations indicated above, all of which effect the process rate, the corresponding cathode current density in existing installations employing direct current excitation of the cathode and anode has been less than 300 amp $m^2$. Even in more sophisticated installations employing pulsating or periodically reversed direct current excitation, the maximum current density practically obtainable is about 600 amp $m^2$.

SUMMARY OF THE INVENTION

The method and apparatus for electrolysis of copper or other non-ferrous metals in accordance with the invention has been found effective to eliminate all of the above-mentioned disadvantages. In an illustratively arrangement, an elongated electrolysis chamber is divided longitudinally into at least first and second adjacent compartments for individually housing the anode and cathode portions of the device. The partition between the first and second compartments is made permeable to the electrolyte in the chamber but impermeable to the solid-sludge-like impurities that are formed at the anode during electrolysis.

The anode is supported in a surrounding basket within the first compartment, and the cathode is longitudinally advanced through the second compartment. During such advance, the interface between the electrolyte and the moving cathode in the second compartment is agitated to increase the motion of the electrolyte layer immediately adjacent the cathode and to thereby increase the rate of crystallization on the cathode of the copper in the solution. During such crystallization, the sludge generated at the anode is prevented from reaching the cathode by the sludge-impermeable barrier between the first and second compartments, and such partition further prevents the flow of oxygen to the cathode. Additionally, the partition prevents the admixture of gases generated at the respective cathode and anode.

Because of the extremely high purity of the crystalliation, the advancing cathode rod, with its accumulated build-up of pure copper, can be directly employed as finished rod stock without the necessity of further melting and reprocessing. For this purpose, it has been found advantageous to rotate the rod about its axis at a slow rate as the rod advances through the electrolytic tank and accumulates its layer of pure electrolytic copper. The required agitation of the cathode-electrolyte interface in the second compartment may be accomplished by vibrating the cathode itself, or alternatively may be accomplished by providing a plurality of longitudinally spaced nozzles on an electrolyte conduit pipe entering the electrolysis chamber in a region below the cathode support in the second compartment. In this case, jets of the electrolyte are directed upwardly from the nozzles toward the cathode surface to provide the agitation.

The electrical excitation of the installation, which can be of either the direct-current or pulsating or reversed direct current-type, may be accomplished by connecting a suitable current source between a fixed contact point on the anode support structure in the first chamber compartment and a wiper structure disposed in the path of advance of the cathode through the second compartment. Such wiper structure is preferably disposed outside the output port of the chamber; alternatively, such wiper structure may be located inside the chamber, if associated with facilities for insolating such structure from contact with the electrolyte.

A sealing device is associated with the output end of the second compartment for trapping electrolyte which is carried along with the moving cathode. The sealing structure conveys the trapped electrolyte into an electrolyte collection tank, which is continuously fedback via a pump to the input end of the electrolyte introduction conduit at the input of the chamber. The sludge and other impurities formed at the anode in the first compartment may be continuously collected via a sump at the bottom of the chamber, and after removal of such impurities, the remaining electrolyte may be combined with the electrolyte collected via the trap structure at the output of the second compartment, and the resulting admixture fed back to the input of the electrolyte conduit.

BRIEF DESCRIPTION OF THE DRAWING

The invention and its various advantages are further set forth in the following detailed description taken in conjunction with the appended drawing, in which.

DETAILED DESCRIPTION

Figure 1:
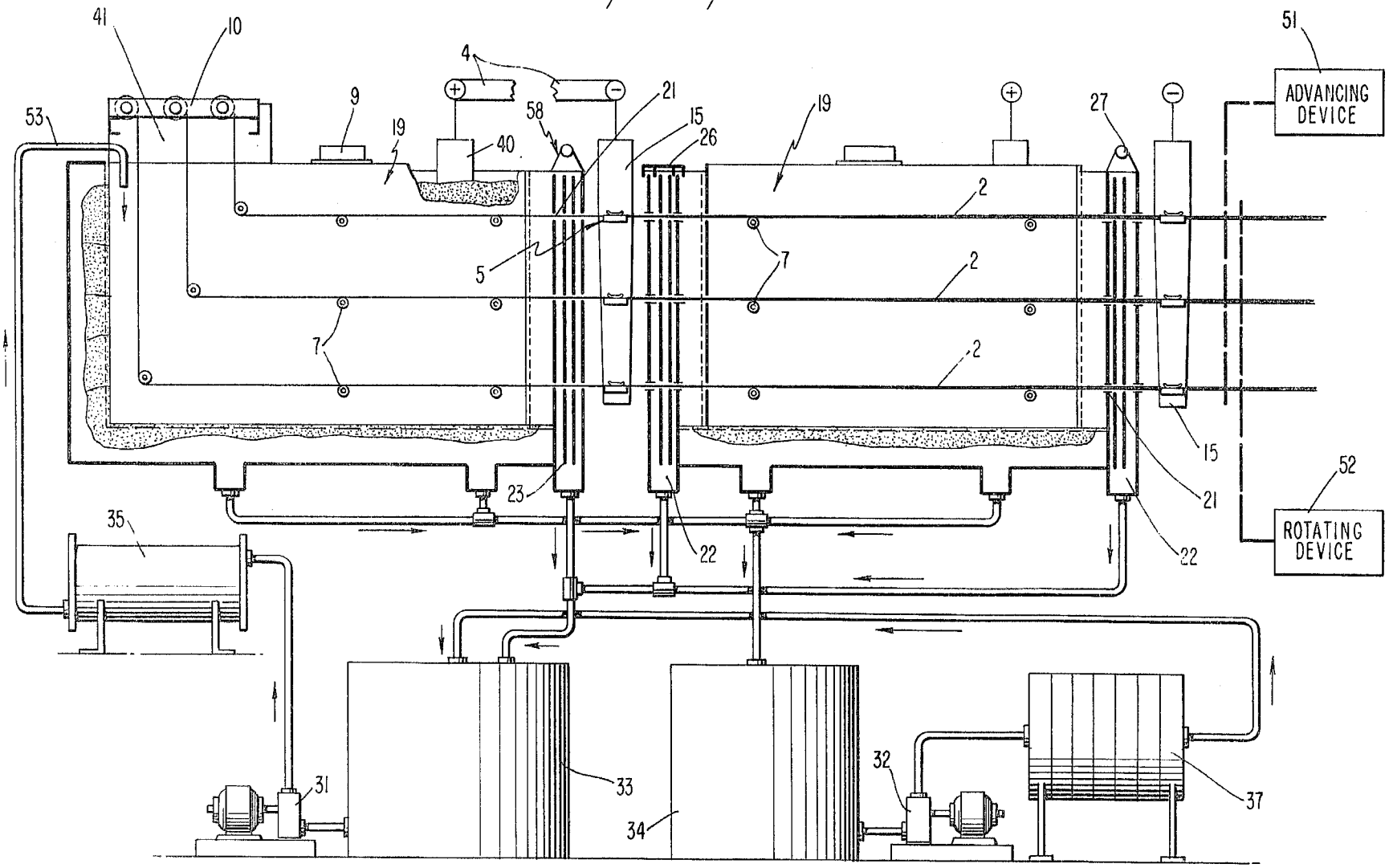
FIG. 1 is a schematic representation of a two-stage installation for carrying out the electrolysis of copper or other non-ferrous metal in accordance with the invention.

Referring now to the drawing, FIG. 1 shows schematically an illustrative installation in accordance with the invention for the electrolysis of a non-ferrous metal, illustratively copper. The particular facility indicated in FIG. 1 is especially adapted for the electrolytic refining of copper material in a raw or unfinished state, such as black copper, fire-refined copper, copper obtained from scrap, etc. The installation of FIG. 1 is also suitable for the electric extraction of copper from a solution.

The installation of FIG. 1 includes an elongated channel 1 which can be one unitary structure or, as depicted in FIG. 1, a plurality of associated elongated sections 19, 19. The number of sections 19 can be selected in accordance with the expected production of the installation and the number of separate channels that can be accommodated therein.

Figure 2:
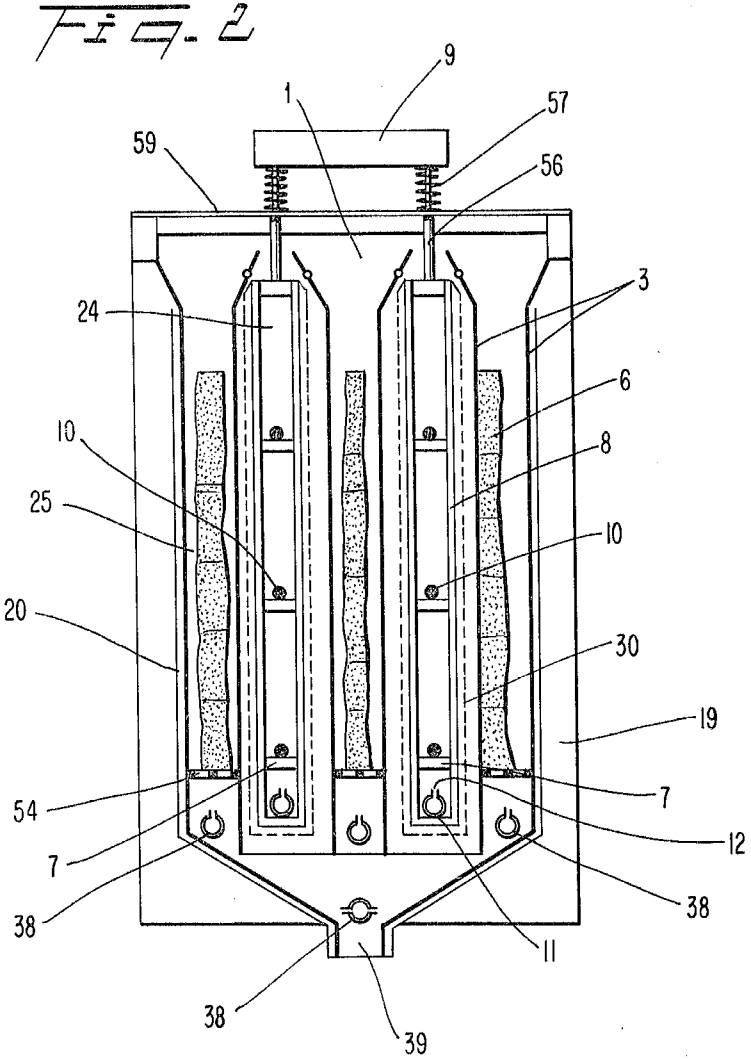
FIG. 2 is a cross-sectional view of a first embodiment of a typical stage of the installation of FIG. 1 suitable for use when the electrolysis involves the refinement of copper.

As shown best in FIG. 2, each of the chamber sections 19 is provided with a housing 20, which may be constructed of structural materials such as reinforced concrete, steel, aluminum, or wood, the housing being internally lined with a suitable acid-resistant material such as lead, lead antimony or polyvinyl chloride.

The interior space of the electrolysis section 19 is divided, by means of electrolyte-permeable membranes 30, into a plurality of cathode spaces 24 alternating with a plurality of anode spaces 25. In the arrangement of FIG. 2, two of the cathode spaces 24 and two of the cathode spaces 25 are depicted.

The membranes 3 may be suitably be formed from one or more layers of acid-resistant filtering cloth, and serve to isolate each cathode space 24 from sludge-like impurities formed during electrolysis at an anode 6 supported in the manner described below in the adjacent anode space 25.

The anode 6 disposed in each of spaces 25 is formed from blocks of raw or partially refined copper which is to be subjected to further refining in the installation 1. The blocks 6 may have any desired cross-section, and may be formed from casting, rolling, pressing, drawing or any other suitable process. As shown in FIG. 1, the blocks 6 extend along the length of the chamber section 19.

The anode blocks 6 are fixedly supported within a plurality of anode baskets 3, 3, which may be suitably secured to the walls of the housing 20. The baskets 3 are formed from electroconductive material which is unaffected by the electrolytic processes going on in the section 19, and typically may be of titanium, lead, stainless steel, or alloys thereof. Like the housing 20, the baskets 3 may be formed from one piece or may consist of interconnected sections in matrix form. The blocks 6 may be conductively joined to the baskets 3 and to an anode bus 40, which in turn is associated with the positive terminal of a suitable DC exciting source 4. The source 4 may constitute a source of steady DC current, or alternatively may be a source of pulsating or periodically reversing direct current. While not explicitely shown in the drawing, the individual anodes 6 disposed in the three anode chambers 25 are suitably coupled in parallel.

Disposed in each of the cathode spaces 24 is a cathode receptacle 8, which contains therein a plurality of spaced struts 7 which in general may be formed of insolating material and which in general are impervious to the electrolysis process within the chamber 19. In FIG. 2, three superposed tiers of the struts 7 are shown, each of the struts being joined to the sides of the receptacle 8. (Alternatively, the struts 7 may be supported directly by the respectively adjacent walls of the anode baskets 3).

A plurality of elongated wires or rods 10, 10 of relatively small circular cross section serve as the cathode bases in the depicted installation. The rods 10 are continuously advanced longitudinally through the cathode spaces 24 and over associated ones of the supports 7. In the arrangement of FIG. 2, three of the rods 10 are supported within each of the cathode receptacles 8. The rods 10 are individually translated through the associated cathode space 24 by means of a conventional advancing device 51. The rods may also be simultaneously rotated on their axis by means of a rotating mechanism 52, either continuously in one direction or in alternately reversing directions.

Each of the bases 10, together with an electrolytic layer of copper accumulated thereon during the electrolysis process, collectively define a cathode 2, which after emergence from the installation 1 is sufficiently pure to serve directly as finished rod stock.

Figure 4Z:
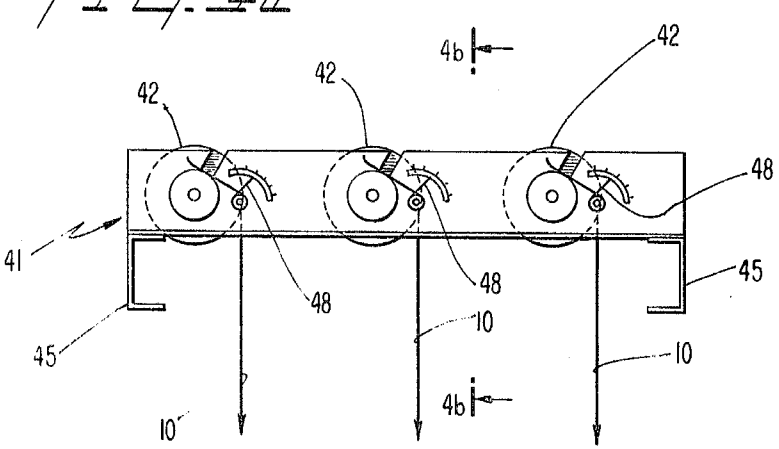
FIG. 4*a* is a view of a plurality of reel-type supporting structures around which copper rod employed as the cathode in the installation of FIG. 1 is wound.
FIG. 4*b* is a view taken along line 4*b*—4*b* of FIG. 4*a*.
Figure 4Z:
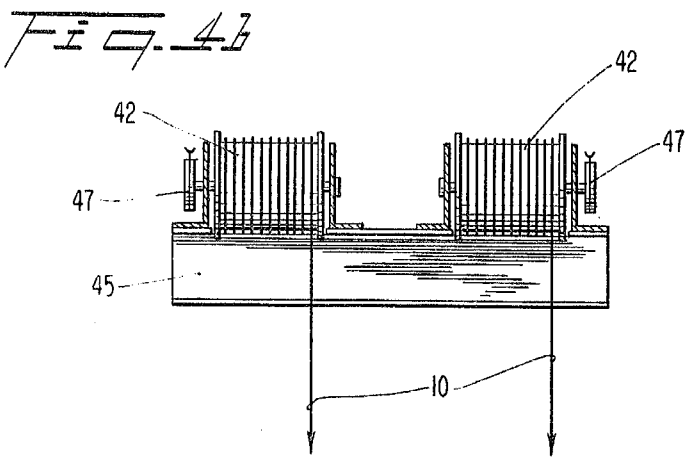

As best shown in FIGS. 4*a* and 4*b*, the continuous rods 10 serving as the cathode bases are individually stored in a magazine 41, where they are wound around associated drums 42 whose shafts 47 are suitably secured in a magazine frame 45. Each of the drums 42 is associated with a braking device 48, which permits the advancing of the rod 10 through the installation 1 at a desired tension. The rolled-up supply of rod 10 is suitably cleaned to permit efficient electro-crystallization thereon, of the electrolytic copper present in the electrolyte (described below) in the chamber section 19. The rolls 42 are replaceable, and the ends of the rod stock 10 on each roll can be suitably joined as by soldering to the front end of the rod stock on the replacing roll, so that a continuous supply of the rod for advancing through the chamber section 19 is assured.

Electrolyte is introduced into the chamber section 19 through an inlet conduit 53, which may be divided within the chamber 19 into a plurality of channel sections 11, 11 and 38,38. In general, the sections 11, 11 extend longitudinally through the cathode spaces 24, and are disposed below the level of the struts 7. The sections 38 extend longitudinally through the anode spaces 25, and are disposed below a plurality of electrolyte-permeable partitions 54,54 associated with the anode baskets 3. If desired, an additional conduit section 38 may be disposed below the level of the anode and cathode spaces 24 and 25, as indicated in FIG. 2. In order to introduce the electrolyte in the sections 11, 38 into the associated space of the chamber section 19, each of such sections is provided with a plurality of longitudinally spaced nozzles 12, 12.

The electrolyte conventionally consists of a solution of copper sulfate and sulfuric acid, together with conventional surface-active substances for promoting effective electro crystallization of copper from the electrolyte onto the adjacent service of the cathode base 10.

The chamber section 19 is further provided with facilities for agitating the interface between the electrolyte and the adjacent surface of the cathode 10 in order to increase the ionic flow between the normally sluggish diffusion top layer of the electrolyte and the cathode surface, thereby leading to a desired increase in process efficiency. Additionally, the localized intensive mixing of the electrolyte and the cathode results in a physical improvement and refinement of the crystal structure of the deposited copper, in addition to an improvement in its chemical purity.

The above-mentioned agitation can advantageously be accomplished by connecting the cathode receptacle 8 in each cathode space 24 to a mechanical oscillator 9 via an associated rod 56 and spring 57. The resultant vibration of the receptacle 8, and thereby the cathode bases 10, can be either continuous or periodic, and exhibits a frequency and amplitude which, in association with the speed of advancement and rotation of the cathode rods 10 and other parameters, is selected to yield an optimum localized mixing of the electrolyte at the adjacent cathode surface for the purpose indicated above.

The above-mentioned agitation may also be accomplished, either alone or in association with the oscillator 9 and the associated structure 56, 57, by the jets of electrolyte directed upwardly toward the cathode bases 10 via the nozzles 12 in the electrolyte conduits 11. The jets emerging from the nozzles 11 result in a wave-like impact of the electrolyte against the lower surface of the moving rod 10, thereby providing the local intensive mixing of the electrolyte at the adjacent cathode surface. The sludge-like particles generated at the anode during electrolysis may be freed from the anode by the jets of electrolyte impinging on the block 6 from the underlying conduit sections 38, or alternatively by intermittently blowing streams of air, by facilities not shown, toward the block 6. The sludge thus loosened from the anode collects at the bottom of the chamber 19, where it may be discharged therefrom in a continuous manner by one of a plurality of longitudinally spaced sump sections 39. The contaminated electrolyte emerging from the chamber 19 is conducted into a tank 34, from which it is propelled via a pump 32 into a suitable filtering device 37. The filtered electrolyte is then stored in a second tank 33, where it is mixed with similarly pure electrolyte from the isolated cathode spaces 24 in the manner discussed below. The combined purified electrolyte in the tank 33 is propelled by means of pump 31 and a preheater 35 into the inlet conduit 53 for recirculation into the chamber section 19.

As a result of the continuous advancement and rotation of the cathode rod 10 through the chamber 19 to slowly build up a pure electrocrystallized layer of electrolytic copper thereon, and of the continuous cleaning and recirculation of the electrolyte through the chamber section 19, the entire installation 1 may be automated and run on a continuous-flow basis without the necessity of periodic shutdowns with their attendant cost, inconvenience and danger to service personnel.

Figure 5A:
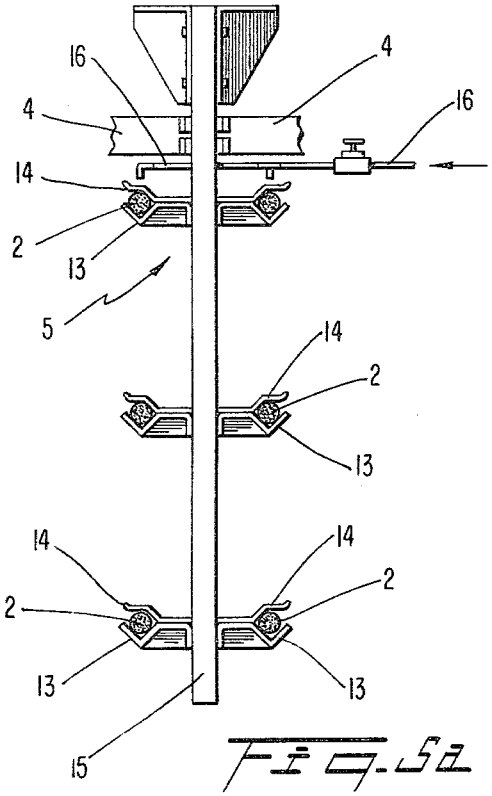
FIG. 5*a* is an elevational view of a first embodiment of wiping structure suitable for applying a negative excitation potential to the moving cathode of FIG. 1.
Figure 5B:
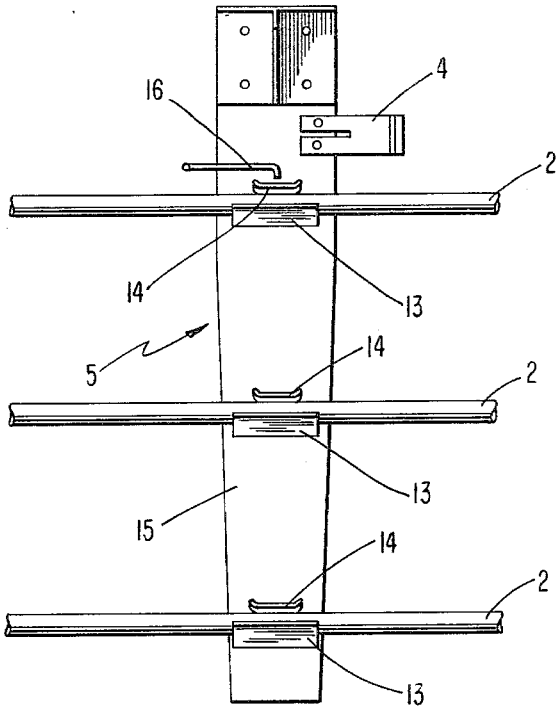
FIG. 5*b* is a side view of the arrangement of FIG. 5*a*.

In order to apply the required electric potential of the current supply 4 to the cathode bases 10 as they advance through the installation 1, a wiping arrangement 5 is supported at the output of each chamber section 19 in sliding engagement with each of the cathode rods 10 advancing through the several cathode sections 24. In the embodiment of FIGS. 5*a* and 5*b*, the wiping arrangement 5 includes a conductive base carrier section 13 with supports the advancing cathode 2 (i.e., the base 10 and its accumulated copper layer), and a resilient clamp section 14 which overlies the cathode 2 and the base portion 13 for urging the cathode toward the base portion. The clamp section 14 and the base portion 13 are each affixed to a cathode bus 15 associated with the negative terminal of the current source 4. The wiping arrangement 5 may be continuously wetted by means of a suitable fluid, such as electrolyte, introduced via a conduit section 16.

Figure 6A:
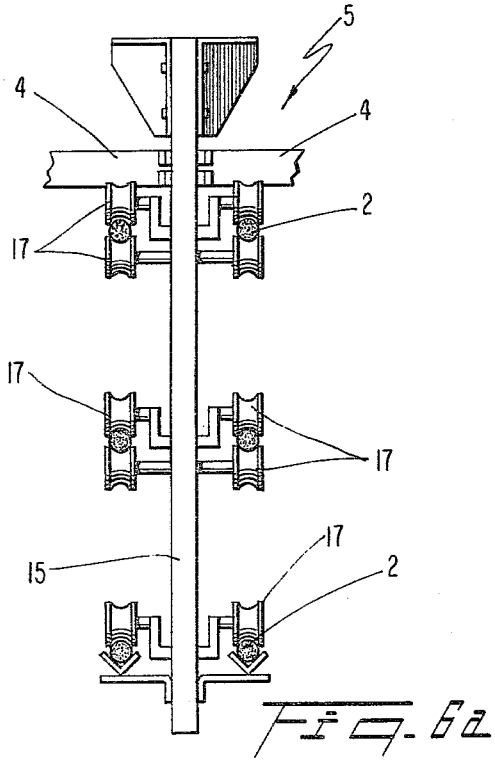
FIG 6*a* is an elevational view of a second type of wiping structure suitable for use in the arrangement of FIG. 1.
Figure 6B:
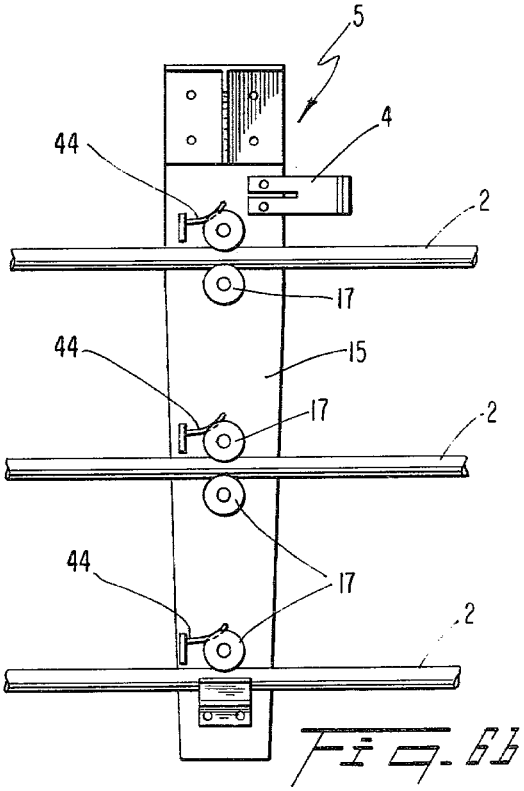
FIG. 6*b* is a side view of the arrangement of FIG. 6*a*.

An alternative arrangement of the wiping arrangement 5 is shown in FIGS. 6*a* and 6*b*. In this case, one or more conductive rolls 17, 17 may be urged against the moving cathode 2 by means of a resilient clamp 44, the rolls and/or the clamp being affixed to the cathode bus 15. Such bus cooperates with the negative terminal of the current supply 4 in the same manner as the arrangement of FIGS. 5*a* and 5*b*.

Figure 7:
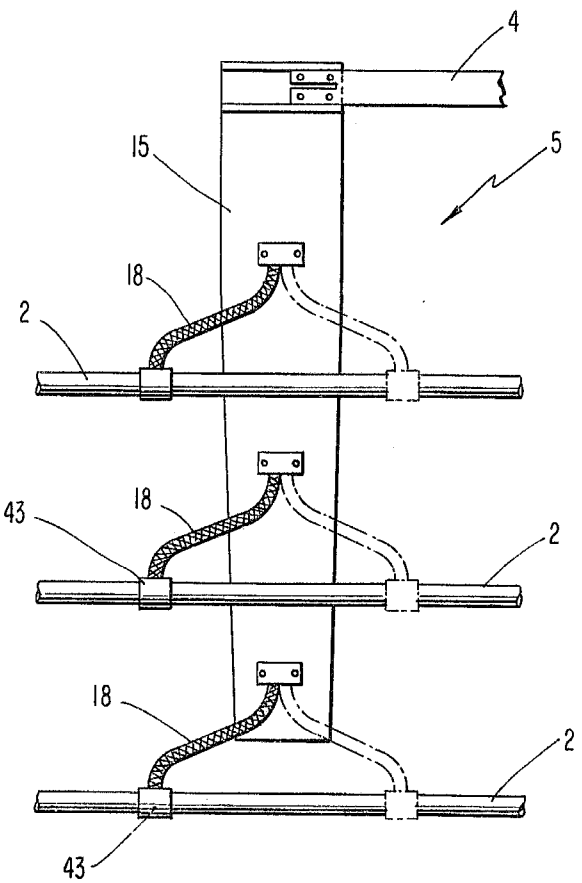
FIG. 7 is an elevational view of still another embodiment of wiping structure suitable for use in the arrangement of FIG. 1.

In FIG. 7, a conductive sleeve 43 may be associated with each of the cathodes 2, such sleeve 2 being arranged to contact a flexible conductive strap 18 which is connectable at its other end with the cathode bus 15 as above. The sleeve 43 may be slidably mounted on the moving cathode 2 for periodic reciprocation therealong as shown.

Referring again to FIG. 1, the output of each chamber section 19 is coupled to an electrolyte trap section 58, which may be in the form of a column having apertures 21, 21 in its front and rear walls for permitting the passage of the several cathode rods 10 therethrough. The section 58 further has a plurality of internal vertical baffle sections 23, which serve to shunt electrolyte passing out of the chamber section 19 along with the moving cathode rod 10 downwardly toward a collecting area 22 at the bottom. The so-shunted electrolyte is routed to the pure electrolyte collecting tank 33, for recirculation to the inlet pipe 53 in the manner described above. If more than one of the chambers 19 is connected in tandem, as in FIG. 1, additional trap sections 58 may be provided at the inlet of the successive conduits 19 on the other side of the wiping arrangement 5.

The top of the trap section 58 may be closed off with a lid 26, or alternatively may be provided with a suitable hood 27 connected to a conduit (not shown) for venting to the atmosphere harmful vapors contained in the electrolyte. As shown in FIG. 2, each chamber section 19 may also be provided with a lid or cover 59.

Figure 3:
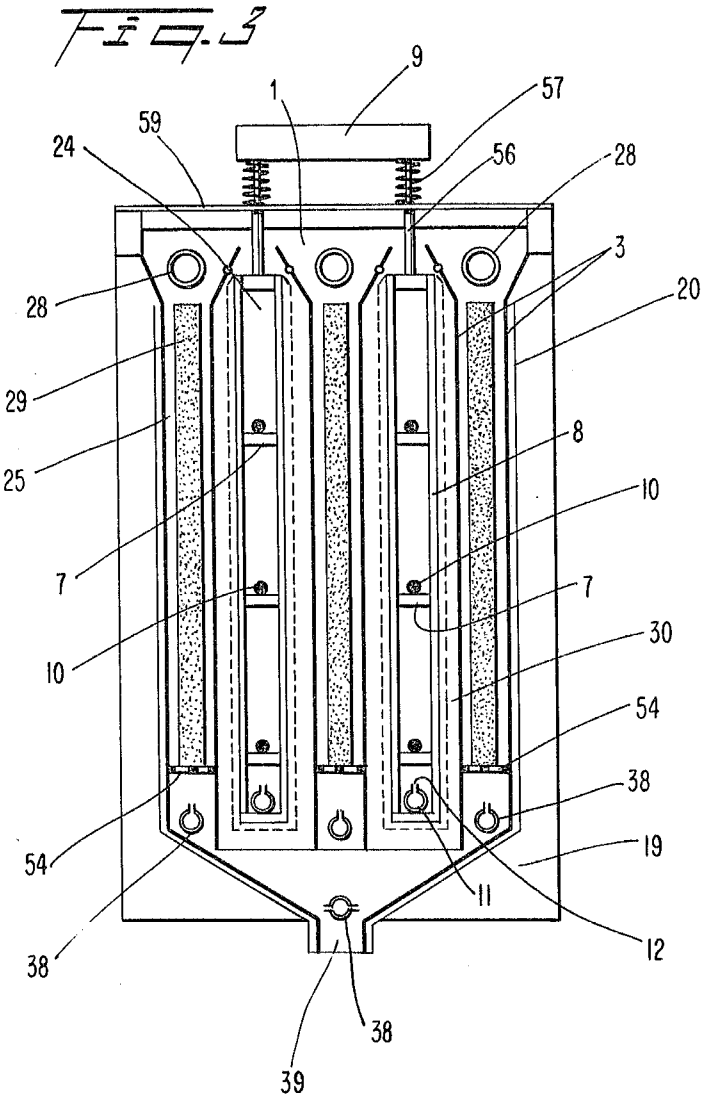
FIG. 3 is a cross-sectional view of an alternative embodiment of a typical stage of FIG. 1 when the electrolysis is employed for the electric extraction of copper from solution.

The chamber section of FIG. 3 is similar to that of FIG. 2, but is particularly adapted for use when the electrolysis to be carried out in the section 19 involves the electric separation of copper from solution. In such case, the anode is embodied as a plate formed from lead or other material which is impervious to the electrolytic process going on in the chamber 19. Also, since under such circumstances oxygen is generated at the anode, a plurality of gas conduits 28, 28 are individually disposed above the lead plates 29 in each anode space 25 for collecting the copper. As indicated above, substantially all the oxygen generated at the anode may be collected for efficient use, since the presence of the membranes 30 effectively prevent an admixture of the gases in the cathode and anode sections, and thereby a contamination of the cathode with such oxygen.

The surface-active additives in the electrolyte may be present in a concentration of several milligrams per liter of liquid, and may typically be gelatin or thiocarbamide. Such concentration generally yields a smooth, dense, fine crystalline structure on the surface of the cathode 2. Such low concentration of the surface-active agent for efficient results is made possible by the above-mentioned agitation of the electrolyte-cathode surface within the cathode spaces 24.

The number of wiper arrangements 5 is determined by the current-carrying capacity of the cathodes 2, and in general may be located between each successive pair of chamber sections 19 in the installation 1. While such wiper arrangements have been shown outside the sections 19, they may also if necessary be disposed within the sections 19 provided only that suitable facilities be incorporated to electrically isolate such arrangement from the electrolyte in the chamber to avoid electrocrystallization of the copper thereon.

It will be understood that while the shape of the elongated copper rod 10 operating as the base of the cathode 2 is illustratively of circular cross-section, it may be given any desired cross-sectional shape, and in any event may be made almost arbitrarily small provided only that it is adapted to commence efficient electrocrystallization of copper from the solution at the input end of the channel section 19. The necessity of expensive and complicated cathode matrix structures is obviated, and the bases 10 with the accumulated layer of copper thereon are suitable for further direct processing without the necessity of further melting and forming.

When electrolysis is carried out with the above-mentioned arrangement, the copper content of the accumulated electrolytic product is normally about 99.995%, and is essentially completely free of occluded gases such as oxygen, and of sludge and other contaminating substances.

Additionally, because of the higher process speeds and process efficiency obtainable with the use of the improved technique, the anode blocks 6 employed when electrolytic refining is involved are essentially completely dissolved, thereby eliminating the necessity of removing residual anode segments from the tank and reprocessing them into blocks.

Additionally, with the technique of the invention, it is possible to obtain cathode current densities as high as 3000 amps per square meter, a figure that is far higher than that obtainable with known prior art techniques. Such marked increase in current density is at least partially due to the intense movement of the electrolyte layer adjacent the surface of the moving cathode, as described above. In fact, the relative rate of movement of the electrolyte is limited only by economic considerations, since the sludge and other impurities that would otherwise reach the cathode from the anode under such conditions is blocked by the presence of the membranes 30.

Without in any way limiting the generality of the foregoing discussion, the following examples are presented to illustrate process conditions and product results obtainable therefrom;

EXAMPLE 1

The arrangement of FIG. 1 was employed for the electrolytic refining of copper, and employed an electrolyte containing 50 grams per liter of copper and 200 grams per liter of free sulfuric acid, together with other suitable admixtures. The cathode current density was 1200 amps per square meter. The moving cathode base was vibrated perpendicular to its axis at a frequency of 200 cycles per minute and an amplitude of 3 mm. The cathode base was a wire of round cross-section having a diameter of 0.4 mm, and at the output end of the electrolysis chamber had accumulated a sufficient amount of electrolytic copper such that the diameter of the emerging cathode was 25 mm. During such advance, the cathodes were rotated about their axis at a speed of one revolution per hour.

EXAMPLE 2

In this case, electrolytic refining of copper was carried on with an electrolyte containing 25 grams per liter of copper and 250 grams per liter of free sulfuric acid. The cathode current density was 800 amps per square meter. The cathodes were vibrated at a frequency of 150 cycles per minute and at an amplitude of about 3 mm. The cathode bases were copper wires having a diameter of 0.6 mm, and the finished cathode emerging from the electrolysis chamber had a diameter of 25 mm. The cathodes were rotated during their advance about their axis at a speed of 0.5 revolutions per hour.

EXAMPLE 3

In this case, electrolytic refining of copper was carried out with an electrolyte containing 30 grams per liter of copper and 150 grams per liter of free sulfuric acid. The cathode current density was 1000 amps per square meter. The cathodes were vibrated at 200 cycles per minute and at an amplitude of about 2 mm. The cathode bases were copper wires having a diameter of 0.3 mm, and the finished cathodes had a diameter of 30 mm. The cathodes were rotated about their axes during the advance at a rate of 2 revolutions per hour.

EXAMPLE 4

Electrolytic refining of copper was carried out with an electrolyte having 70 grams per liter of copper and 100 grams per liter of free sulfuric acid. The cathode current density was 2000 amps per square meter. The vibration of the cathode took place at 30 cycles per minute and at an amplitude of about 3 mm. The cathode bases were copper wires having a diameter of 1 mm, and the finished cathodes had a diameter of 25 mm. The cathodes were rotated about their axis at a speed of 2 revolutions per hour.

EXAMPLE 5

In this case, electrolytic refining of copper was carried out an electrolyte containing 20 grams per liter of copper and 200 grams per liter of free sulfuric acid. The cathode current density was 700 amps per square meter, and the cathode vibration took place at 100 cycles per minute and with an amplitude of about 1 mm. The cathode bases were copper wires having a diameter of 0.5 mm, and the finished cathodes at the outlet had a diameter of 20 mm. The rotational speed of the cathodes about their axes was 1 revolution per hour.

EXAMPLE 6

In this case, the installation of FIG. 1 was employed for the electric extraction of copper from an electrolyte which, at the inlet of the channel, exhibited about 30 grams per liter of copper and 15 grams per liter of sulfuric acid. At the outlet of the installation, the electrolyte exhibited about 15 grams per liter of copper and 40 grams per liter of sulfuric acid. The process took place at a cathode current density of 1000 amps per square meter. The cathodes were vibrated perpendicular to their axes at a frequency of 500 cycles per minute. The cathode bases were copper wires having a diameter of 0.6 mm. The finished cathodes at the outlet of the installation had a diameter of 20 mm. The rotational speed of the cathodes about their axes was 1 revolution per hour.

EXAMPLE 7

Electric extraction of copper was accomplished from an electrolyte having 50 grams per liter of copper and 6 grams per liter of sulfuric acid at the inlet of the installation, and 15 grams per liter of copper and 80 grams per liter of sulfuric acid at the outlet of the installation. The cathode current density was 1500 amps per square meter. The vibration frequency was 200 cycles per minute. The cathode bases were wires having a diameter of 0.4 mm, and the finished cathodes had a diameter of 25 mm. The rotational speed of the cathodes about their axis was 0.5 revolutions per hour.

EXAMPLE 8

In this case, electric extraction of copper was accomplished using an electrolyte which at the input contained about 20 grams per liter of copper and 10 grams per liter of sulfuric acid, and at the outlet about 10 grams per liter of copper and 40 grams per liter of sulfuric acid. The cathode current density was 700 amps per square meter. The vibration frequency was 600 cycles per minute. The cathode bases were copper wires having a diameter of 0.6 mm, and the finished cathodes had a diameter of 25 mm. The rotational speed of the cathodes about their axes was 1 revolution per hour.

In the foregoing, several embodiments of the invention have been described. Many variations and modifications will now occur to those skilled in the art. It is accordingly desired that the scope of the appended claims not be limited to the specific disclosure herein contained.

What is claimed is:

1. In a method for the electrolysis of a non-ferrous metal comprising the steps of moving a cathode longitudinally through an electrolysis chamber, associating an anode with the chamber in spaced relation to the moving cathode, the improvement which comprises the steps of introducing at least one jet of electrolyte into the electrolysis chamber in a direction normal to the cathode so as to form a turbulent flow therein to turbulently agitate the interface between the cathode and the electrolyte and positioning an anode longitudinally in the chamber parallel to and transversely spaced from the moving cathode, and positioning a solid, electrolyte-permeable membrane longitudinally in the chamber parallel to and intermediate the anode and the moving cathode to inhibit the flow of gases and impurities therebetween.

2. A method as defined in claim 1, in which the cathode is a rod of substantially circular cross-section.

3. A method as defined in claim 1, further comprising the step of reciprocally rotating the rod about its axis as the rod is advanced.

4. A method as defined in claim 1, in which the method further comprises supporting the moving cathode on a longitudinally extending support within the chamber, and in which the agitating step comprises vibrating the support.

5. A method as defined in claim 1, in which the agitating step comprises directing at least one jet of the electrolyte upwardly against the moving cathode.

* * * * *